United States Patent [19]

Zierhut

[11] Patent Number: 4,529,874

[45] Date of Patent: Jul. 16, 1985

[54] MOTION DETECTOR FOR SPACE SURVEILLANCE

[75] Inventor: Hermann Zierhut, Munich, Fed. Rep. of Germany

[73] Assignee: Richard Hirschmann Radiotechnisches Werk, Esslingen am Neckar, Fed. Rep. of Germany

[21] Appl. No.: 672,842

[22] Filed: Nov. 16, 1984

Related U.S. Application Data

[63] Continuation of Ser. No. 398,799, Jul. 16, 1982.

[30] Foreign Application Priority Data

Jul. 17, 1981 [DE] Fed. Rep. of Germany ..... 3128256

[51] Int. Cl.[3] ..... G08B 13/18

[52] U.S. Cl. ..... 250/221; 340/555; 340/567

[58] Field of Search ..... 250/221, 209, 210; 340/555-557, 567, 573; 358/105

[56] References Cited

U.S. PATENT DOCUMENTS

| | | | |
|---|---|---|---|
| 3,396,279 | 8/1968 | Tokuda | 250/221 |
| 3,502,883 | 3/1970 | Archer | 250/210 |
| 3,524,180 | 8/1970 | Cruse | 340/567 |
| 3,760,399 | 9/1973 | Schwarz | 340/567 |
| 3,858,192 | 12/1974 | Fischer | 340/555 |
| 3,928,843 | 12/1975 | Sprout et al. | 340/567 |
| 4,263,585 | 4/1981 | Schaefer | 250/221 X |

*Primary Examiner*—Edward P. Westin

*Attorney, Agent, or Firm*—Karl F. Ross; Herbert Dubno

[57] ABSTRACT

A motion detector responsive to infrared radiation, e.g. for use in burglar-alarm installations, comprises a pair of juxtaposed sensors monitoring adjacent fields of view of a space to be surveyed, giving rise to output signals of opposite polarity upon detecting a disturbance in their respective fields. These output signals are fed to an evaluator comprising two complementary transistors with interconnected emitters and interconnected bases whose junctions are separated by a resistive branch of an RC network, the emitter junction receiving the output signals while the base junction is capacitively coupled to ground or some other point of fixed potential. The collectors of these transistors, energized via respective resistors from opposite terminals of a d-c supply, are connected to respective timers working into a common AND gate which triggers an alarm when an alternation of output signals from the two sensors renders the timers conductive for overlapping periods.

3 Claims, 2 Drawing Figures

MOTION DETECTOR FOR SPACE SURVEILLANCE

This application is a continuation of co-pending application Ser. No. 398,799 filed on July 16, 1982.

FIELD OF THE INVENTION

My present invention relates to a motion detector used to survey a predetermined space, e.g. as part of a burglar-alarm installation.

BACKGROUND OF THE INVENTION

The type of motion detector here considered comprises a device for sensing incident radiation, usually infrared rays, which may be emitted by an associated source elsewhere in the space under surveillance and whose interruption by an intruder sets off an alarm. Alternatively, such a device can be used to sense heat waves from the body of the intruding person.

Usually, e.g. as known from U.S. Pat. No. 3,958,118, devices of this kind comprise a plurality of closely juxtaposed sensors toward which incident rays from various zones—referred to hereinafter as fields of view—of the surveyed space are directed by suitable focusing means. Thus, an intruder moving through that space will consecutively activate several such sensors and thereby give rise to output signals distinguishable from random noise or background radiation. In the system of the aforementioned U.S. Patent, the outputs of all the sensors are connected in parallel to the gate of a field-effect transistor working into an analog amplifier which differentiates the output signal of any sensor so as to generate pulses of opposite polarities of the leading and trailing edges of that signal. These pulses, upon integration and if above a certain threshold, are fed to an AND gate to trigger an alarm generator whenever the interval between the two opposite-polarity pulses is short enough and their magnitudes are large enough to let their integration products overlap. The threshold is so chosen that the motion detector responds only to at least two consecutive output pulses taken as an indication that an intruder has traversed two adjoining fields of view.

So-called window discriminators designed for the establishment of certain time periods, operating with fixed voltage thresholds, generally must include circuits with large time constants designed to prevent spurious triggering. These time constants, which may have magnitudes on the order of several minutes depending on the number of stages, tend to delay the activation or reactivation of a motion detector and may therefore unduly impede the work of a service person testing its operation. Moreover, minor irregularities such as manufacturing tolerances and capacitor leakages may have an unbalancing effect which may cause false alarms even in these cases.

OBJECTS OF THE INVENTION

The primary object of my present invention is to provide a motion detector of the general type referred to which is more sensitive than conventional systems to disturbances of the kind here considered while being less prone to register false alarms.

A more particular object of my invention is to provide means in such a device for detecting the movement of an intruder—at or above a certain minimum speed—across but a single field of view, rather than across two adjoining fields as in the known system referred to.

A further object of my invention is to provide means for stabilizing the signal-evaluating circuitry of such a motion detector against the emission of spurious acoustic alarms or other disturbance-indicating signals without the need for integrating networks of very large time constant.

SUMMARY OF THE INVENTION

I realize these objects, in accordance with my present invention, by the provision of photoelectric transducer means including a first and a second sensor converting radiation incident upon the first sensor into a positive output signal and radiation incident upon the second sensor into a negative output signal. With the aid of associated focusing means, the two sensors receive incident radiation from at least one pair of adjoining fields of view. A first and a second pulse generator, forming part of an evaluation stage, are respectively triggerable by the positive and the negative output signals of the transducer means for emitting timing pulses of predetermined duration. An alarm is generated in response to a partial coincidence or overlap of these two timing pulses, i.e., when their periods overlap, as will be the case when an intruder moves across one field of view and enters an adjoining one without necessarily traversing the latter.

Pursuant to a more particular feature of my invention, the evaluation stage comprises a pair of mutually complementary semiconductor components having a common input connected to the transducer means and having outputs respectively connected to the two pulse generators. These semiconductor components could simply be designed as diodes, yet I prefer to use therefor a pair of transistors with emitters interconnected at a first junction and bases interconnected at a second junction. By connecting one of these junctions—preferably the emitter junction—to the transducer output as a common input terminal and inserting between the two junctions a resistive branch of an RC network whose capacitive branch couples the other junction to ground or to some other point of fixed potential, I can provide the two transistors with a reference voltage which equals their input voltage under static conditions and follows that input voltage with a certain lag (determined by the time constant of the RC network) whenever one of the sensors generates an output signal. Such an adaptive evaluator will therefore be nonresponsive to relatively slow changes in background radiation due, for example, to the incidence of sunlight into the protected premises. The time constant of the RC network should, of course, be so chosen that one or the other transistor will conduct when the input voltage changes at a rate corresponding to the slowest motion to be detected.

BRIEF DESCRIPTION OF THE DRAWING

The above and other features of my invention will now be described in detail with reference to the accompanying drawing in which.

SPECIFIC DESCRIPTION

Figure 1:
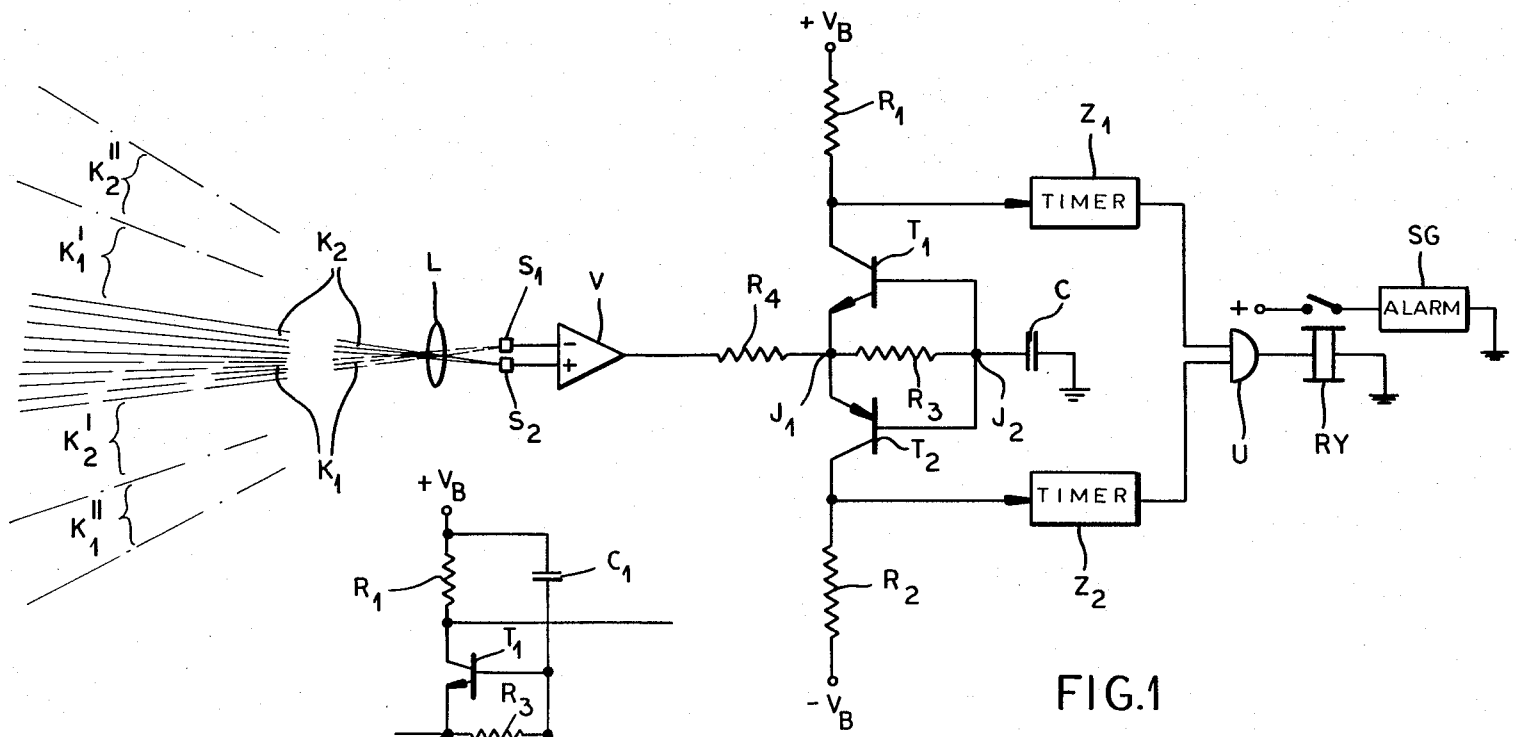
FIG. 1 is a circuit diagram of a motion detector embodying my invention.

FIG. 1 shows, diagrammatically, two fields of view $K_1$, $K_2$ from which incident infrared rays are focused upon respective thermoelectric sensors $S_1$ and $S_2$ by means schematically represented by a lens L. The two fields of view $K_1$ and $K_2$ are a pair of adjoining sectors forming part of two interleaved sets of such sectors also including fields $K_1'$, $K_1''$ and $K_2'$, $K_2''$. Sensor $S_1$, therefore, may comprise several discrete areas positioned to receive the rays of fields $K_1$, $K_1'$ and $K_1''$, these areas being interspersed with similar areas of sensors $S_2$ receiving the rays of fields $K_2$, $K_2'$ and $K_2''$. Lens L may, of course, be replaced by a more elaborate focusing device of the type described, for example, in U.S. Pat. No. 3,958,118 discussed above. Other focusing devices suitable for this purpose have been described in my copending application Ser. No. 379,079 filed May 17, 1982 whose disclosure is hereby incorporated by reference into the present application. The devices of my copending application are distinct from those of the prior art by ingathering beams of parallel rather than converging rays from their respective fields of view.

Whatever the nature of the focusing means L, the focal length thereof may range between about 40 and 100 mm and the fields of view $K_1$, $K_2$ may have an effective width on the order of 1 meter in a region to be particularly monitored, e.g. the area of an entrance door.

Sensors $S_1$ and $S_2$ respectively work into an inverting and a noninverting input of an operational amplifier V which together with them acts as a photoelectric transducer whereby radiation incident on any area of sensors $S_1$ or of sensor $S_2$ respectively gives rise to a negative or a positive output voltage in the amplifier output. Amplifier V may have an operative frequency range with a lower limit of about 1 Hz. Its output signals are transmitted via a resistor $R_4$ to a junction $J_1$ of the emitters of two complementary transistors, namely an NPN transistor $T_1$ and a PNP transistor $T_2$, whose bases are also interconnected at a junction $J_2$. The collectors of transistors $T_1$ and $T_2$ are connected by way of respective resistors $R_1$ and $R_2$ to positive voltage $+V_B$ and negative voltage $-V_B$ available at opposite terminals of a d-c power supply which is assumed to be balanced with reference to ground. The collectors are further connected to trigger inputs of respective timers $Z_1$ and $Z_2$ designed, for example, as mutually complementary monoflaps responsive to negative-going and positive-going pulses whose absolute magnitudes exceed a certain threshold. Timers $Z_1$ and $Z_2$ have their outputs connected to respective inputs of an AND gate U which, upon conducting, energizes a relay RY to actuate a sound generator SG, such as a siren, emitting an alarm signal. The operating period of each timer may be so chosen as to establish a discriminator window of about 3 seconds, for example; this corresponds to a minimum speed of around 35 cm/sec of an intruder moving across a field of view roughly one meter wide as noted above.

The two junctions $J_1$ and $J_2$ are conductively interconnected by a resistor $R_3$ constituting one branch of a time-constant network whose other, capacitive branch consists of a grounded condenser C. Thanks to the connection of this condenser to the base junction $J_2$ rather than to the emitter junction $J_1$, and to the application of the input signal to the emitter junction, the capacitance of condenser C may be reduced by the current gain of the transistors from what it would otherwise be for a given time constant and magnitude of resistor $R_3$. By way of example this capacitance may be about 5 $\mu$F when network $R_3C$ has a time constant of, say, about 20 seconds in a system designed to detect an intruder moving at a minimum speed of a fraction of a meter per second from one field of view to another.

Figure 2:
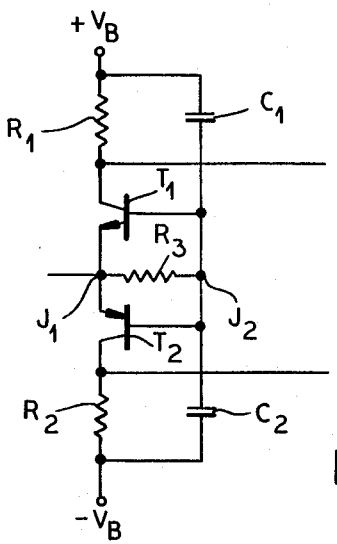
FIG. 2 is a fragmentary circuit diagram illustrating a partial modification of the system of FIG. 1.

If no ground connection is conveniently available, the capacitive branch of the RC network may be modified as shown in FIG. 2 in which two condensers $C_1$ and $C_2$ are respectively inserted between base junction $J_2$ and the positive and negative terminals of the d-c supply.

I have found that a motion detector according to my invention has an immunity against false alarms exceeding by up to 40 dB that of conventional systems of the same general type. The use of an RC network with a time constant on the order of tens of seconds, rather than minutes as in stabilized prior-art threshold comparators, avoids the aforementioned inconveniences while still providing the necessary safeguards against untimely triggering.

I claim:

1. In a motion detector for surveying a space which comprises at least two sensors responsive to electromagnetic radiation in the optical range, an optics (L) for generating a viewing field for said sensors, an amplifier connected to said sensors and having a lower boundary frequency of about 1 Hz, and an evaluating circuit for triggering an alarm upon the change of the radiation intensity, and an alarm unit operated by said evaluating circuit for triggering an alarm upon the change of the radiation intensity, the improvement wherein:

said sensors are provided in at least one pair of two sensors ($S_1$, $S_2$) operating in opposite senses and each associated with a respective viewing zone ($K_1$, $K_2$) in said field;

the optics (L) provides said zones so that they lie adjacent one another at least in a partition region between said zones; and said evaluating circuit triggers an alarm only when, within a predetermined time period, a positive pulse and a negative pulse are generated in succession by said amplifier, said evaluating circuit including:

a pair of mutually complementary semiconductor components ($T_1$, $T_2$) with a common input ($J_1$) connected to said amplifier (V), respective timers ($Z_1$, $Z_2$) connected to outputs of said semiconductor components, and an AND-gate (U) connected to said timers for triggering upon the coincidence of signals from said timers, said AND-gate being connected to said alarm unit (SG) for activating same.

2. The improvement defined in claim 1 wherein said timers are complementary and said semiconductor components are transistors with emitters interconnected at said common input and collectors forming said outputs of said components, said bases being interconnected at a junction, said junction being connected to at least one capacitor forming a RC network.

3. The improvement defined in claim 2 wherein a respective capacitor is connected between a respective voltage source and the base of each of said transistors, each voltage source being connected to the collector of the respective transistor by a resistor forming a part of said RC network with the respective capacitor.

* * * * *